US005685668A

United States Patent [19]

Justice

[11] Patent Number: 5,685,668

[45] Date of Patent: Nov. 11, 1997

[54] BARRIER WALL INSTALLATION SYSTEM

[76] Inventor: Donald R. Justice, 2309 Hancock Bridge Pkwy., Cape Coral, Fla. 33990

[21] Appl. No.: 301,602

[22] Filed: Sep. 7, 1994

[51] Int. Cl.[6] ..... E02D 5/20; E02F 5/06

[52] U.S. Cl. ..... 405/267; 405/258; 405/270; 405/176

[58] Field of Search ..... 405/267, 270, 405/50, 266, 258, 129, 174–183

[56] References Cited

U.S. PATENT DOCUMENTS

| | | | |
|---|---|---|---|
| 3,182,459 | 5/1965 | Grether et al. | 405/270 X |
| 3,893,302 | 7/1975 | Peterson | 405/267 |
| 4,252,462 | 2/1981 | Klingle et al. . | |
| 4,296,884 | 10/1981 | Luebke . | |
| 4,337,006 | 6/1982 | Lacey | 405/50 X |
| 4,352,601 | 10/1982 | Valiga et al. . | |
| 4,358,221 | 11/1982 | Wickberg . | |
| 4,366,846 | 1/1983 | Curati, Jr. . | |
| 4,458,456 | 7/1984 | Battle . | |
| 4,484,835 | 11/1984 | van Klinken . | |
| 4,543,016 | 9/1985 | Tallard . | |
| 4,557,633 | 12/1985 | Dyck | 405/268 |
| 4,607,981 | 8/1986 | van Klinken . | |
| 4,720,212 | 1/1988 | Steenbergen et al. . | |
| 4,741,644 | 5/1988 | Cavalli et al. . | |
| 4,806,043 | 2/1989 | Fournier . | |
| 4,863,312 | 9/1989 | Cavalli . | |
| 4,871,281 | 10/1989 | Justice . | |
| 4,877,358 | 10/1989 | Ressi Di Cervia . | |
| 4,927,292 | 5/1990 | Justice . | |
| 4,929,126 | 5/1990 | Steenbergen et al. | 405/267 |
| 5,118,230 | 6/1992 | Justice . | |
| 5,252,226 | 10/1993 | Justice . | |

FOREIGN PATENT DOCUMENTS

| | | | |
|---|---|---|---|
| 0297625 | 12/1988 | Japan | 405/267 |
| 618481 | 8/1978 | U.S.S.R. . | |
| 2188965 | 10/1987 | United Kingdom | 405/267 |

*Primary Examiner*—Dennis L. Taylor

*Attorney, Agent, or Firm*—Jacobson, Price, Holman & Stern, PLLC

[57] ABSTRACT

An apparatus for delivering liner material into a trench prevents sidewall collapse in a subsurface water saturated zone, provides for inspection of vertical joints, avoids the necessity for dewatering of an area to be trenched, and provides continuous rolls of liner material which are joined by vertical and horizontal seams to accommodate any length or configuration of placement. To initiate unrolling of a length of liner material, a roll of material is dropped into the installation apparatus which trenches into the subsurface. One end of the liner material is held in place by restraints and hydraulic presses. The roll is then unrolled by trenching backwards, cutting a trench and unfurling the roll in the formed trench.

21 Claims, 8 Drawing Sheets

BARRIER WALL INSTALLATION SYSTEM

FIELD OF THE INVENTION

The present invention relates to a barrier wall system including a wall of high-density polyethylene (HDPE) to provide isolation, containment and separation of subsurface environments such as prevention of leakage through levees, isolation of wetlands and sensitive areas and control of vapor and groundwater flow.

BACKGROUND OF THE INVENTION

U.S. Pat. No. 5,118,230 for a Leachate Containment System discloses an installation method and equipment, including a delivery system, to install an impermeable barrier around a contaminated area. This leachate containment system patent shows an impermeable liner that is folded in such a way that it travels into a delivery system from a tractor and is spread, much like a window shade, underneath the ground to stop or contain migrating fluids.

The system disclosed in the leachate containment system patent suggests the inclusion of a length of perforated pipe buried at a spacing from an impermeable barrier liner. The lengths of perforated pipe are buried as described in U.S. Pat. No. 4,871,281 for a Trenching Tool For Installing Perforated Pipe. By the installation of a length of perforated pipe between an impermeable barrier liner and a source of contamination, the groundwater outside the containment area is caused to migrate into the containment area by passing under the impermeable barrier liner so as to continuously move water into a contaminated site for recovery and recycling, to thereby prevent escape of contaminated water from within the impermeable liner.

SUMMARY OF THE INVENTION

By the present invention, a barrier wall system is installed by a trenching tool similar to the trenching tool disclosed in U.S. Pat. No. 5,118,230, hereby incorporated by reference. However, the installation of the liner material is done in a manner different and by a different apparatus than previously known. According to the present invention, extended lengths of flexible impermeable or permeable liner material are located in a delivery system in a vertical orientation. Adjacent sections or lengths of liner material are secured to each other by welding, induction, pressure, press fit, or several other ways so as to form a vertical seam and thereby form infinite lengths of liner material and accordingly infinite areas around which the liner material may be installed. The trencher operates to form trenches to a depth from 10 to 60 feet with the trencher operating at an angle of approximately 20°± vertical to approximately 20°± vertical.

According to the present invention, the apparatus delivering the liner material prevents sidewall collapse in a subsurface water saturated zone, provides for inspection of vertical joints, avoids the necessity for dewatering the area to be trenched, and provides continuous rolls of liner material which are joined by vertical seams to accommodate any length or configuration of placement. In the instances where a vertical depth is greater than a standard height roll of HDPE, horizontally-extending seams are formed to increase the height of the liner material to the intended depth of a trench.

A vertical tongue and groove hydrophilic joint seal or leak-proof joint assembly may be made between adjacent sections of liner material while a new section of liner material is still on a dispensing roll spindle. With a tongue and groove joint, for example, it is possible to weld the complementary shaped portions of the tongue and groove joint assembly to lengths of liner material in a non-stress, clean environment.

According to one liner rolling system, a roll of 40–150 mil HDPE membrane liner material, and preferably 40–100 mil thickness, is taken from the factory, set up on special jigs and the original roll unrolled onto a spindle that fits into the trenching delivery system of the present invention. One part of a tongue and groove joint assembly is heat welded onto a terminal vertical edge of the liner material on the spindle.

The tongue and groove joint assembly is used to interlock adjacent sections of liner material. The tongue and groove joint assembly connectors are located on both ends of a roll of material which has been unrolled from a factory roll, then rerolled onto a spindle to create a proper diameter roll for insertion into the trenching system. Adjacent sections of successive liner material include a complementary portion of the tongue and groove joint assembly to lock with a preceding, already installed, section of liner material.

To initiate unrolling of a length of liner material, a roll of material is lowered by crane into the installation delivery system apparatus which trenches into the subsurface. One end of the liner material is held in place in the trench by restraints and hydraulic presses. The roll is then unrolled by trenching forwards or backwards by a cutting assembly, cutting a trench and unfurling the roll in the formed trench, typically of a 14" width.

Another system for connecting adjacent lengths of liner material include putting a roll of material in a delivery system box on the trenching tool, unrolling the liner material in a formed trench until reaching the end of the liner material section, holding the end of the liner material section by a clamp in the delivery system box and lowering by crane, another roll of liner material in place in the delivery system box of the trenching tool. The two ends of the liner material sections are overlapped and welded together inside the delivery system box by fusion welding or other means of welding the liner material, such as HDPE, for example.

The liner section delivery system box includes a spindle for receiving a roll of vertically-oriented liner material, hydraulic presses, submersible sludge pumps, and special seals or gaskets where the liner material moves through an end opening of the system into the trench that is cut. There is a special brake on the spindle that gauges and accordingly adjusts the tension on the liner material by controlling payout speed of the turntable on which the spindle is located. There are also hydraulic rams that correctly position the delivery system at all times to allow the liner material to be unfurled from the roll at a precisely correct angle dependent on the angle of the terrain over which the trenching tractor is moving. These hydraulic rams also tilt the cutter head and the delivery system from side to side to keep them perfectly vertical, as will be required when trenching to a depth of 40–50 feet.

The turntable that the liner spindle sits on needs to be kept free from silt and infiltrated sands, while being allowed to operate freely to avoid jams. A roll tightener keeps the liner material coming evenly from the roll through the hydraulic closing system to the seals and through the seals into the outside of the delivery system or into the trench.

Optimally, it is possible that a fluid will need to be put inside the liner delivery system to equalize hydrostatic head pressure inside the system with the head pressure outside the system to keep infiltration from occurring at a fast rate through the seals. This provides the possibility of pumping clean water in, taking sand particles and silty water from the sump that is controlled through a submersible pump and always maintaining a higher water level inside the delivery system box than is outside the delivery system box so the flow of water is from inside to out, thus avoiding inflow of silty sand into the delivery system and clogging up the works. The liner delivery system will also operate without input of liquid, or it is possible to pressurize inside the delivery system box with air to achieve the same result of keeping water out.

During trenching, it is possible to backfill into the formed trench with a grout or Bentonite slurry or neat cement or pea gravel concrete or any kind of a backfill such as sand or gravel, for example, to be put in place around both sides of the liner material to keep the liner straight. Simultaneously, a structural wall can be formed along with the impermeable barrier.

The liner material delivery system includes a pipe delivery tube alongside the liner to enable a horizontal well to be placed alongside the liner material at any depth from four feet to the bottom depth of the liner material for free product recovery, for liquid recovery, for liquid injection, for air injection or vapor extraction. Optimally, there can be a plurality of pipes such as is disclosed in U.S. Pat. No. 5,252,226, hereby incorporated by reference, installed on one side or the other of the liner material at different depths to allow remediation or recovery processes to take place. When the liner material is installed in a circle, with the linear contaminate remediation system (LCRS) installed inside the circle, an in-situ reactor is formed which can be used with physical, chemical or biological treatment methods.

It is contemplated as being within the scope of the present invention to use a permeable (ion selective membrane) liner material, so as to let contaminated groundwater flow through the liner material and have the liner material impregnated with treatment compounds, treatment minerals or treatment catalysts, that allow contaminated water, as it passes through the liner material, to be treated in-situ. The permeable liner material forms a treatment wall or treatment barrier. The treatment wall can be connected to a vertical well on one end and be formed of a two-ply wall; one ply permeable and the other ply non-permeable. A free product or a groundwater collective and recovery zone is thereby formed, stopping contaminated groundwater and directing it to the vertical well attached to one end of the liner material for recovery and treatment. Hence, instead of using three or four horizontal wells as disclosed in U.S. Pat. No. 4,927,292 to cover 18 or 20 feet of depth, the whole depth of 10 to 50 feet is covered in a recovery system that directs flow through the permeable part of the liner material recovery system to the vertical well, due to the liquid not being able to penetrate the second impermeable liner material of the barrier.

By placing a permeable barrier liner along a beachface, the permeable liner material will let water flow freely through as the tide changes, and when the tide comes up, the water flows in and through the permeable liner material. As the tide goes out, the water flows back out and through the permeable liner material to let the water flow freely through each side, but without letting any sand flow through. Hence, an installed vertical wall of permeable liner material could be used to make an island as a big sandbag, keeping sand in place and not having the sand affected by increasing or retreating tides or groundwater flows due to high rainfall on barrier islands.

Another use of the present invention is a separation of two bodies of water. A subsurface dam is created which will allow for the height of water tables and wetlands to increase on one side and hold the groundwater off of an area to be protected. This application would be useful in the Everglades of Florida where it is desirous to increase the water levels in the Everglades but not in the adjacent farmlands.

Another problem overcome by the use of the present invention is the problem encountered with contaminated soil. According to applicable regulations, once hazardous contaminated soil is removed from the earth, it must be disposed of according to expensive hazardous waste regulations. By the present invention, a trencher or backhoe digs a trench to a depth of three or four feet or the level at which contamination of the soil begins. After removal of the non-contaminated soil, the trenching machine and liner material delivery system of the present invention is placed in the ground into the contaminated soil, with the contaminated soil excavated by the cutting assembly being returned to the pre-cut trench below the surface on opposite sides of an installed membrane liner. After installation of the liner material, the remaining three to four feet or the depth of dirt removed above the contaminated soil, is backfilled or replaced by other fill material.

It is also an advantage of the present invention to use two cutter assemblies on opposite sides of a liner material delivery system with the cutter assemblies being pivotally mounted to the liner material delivery system. The pivotal movement of the cutter assemblies forms a trench of a preferred width up to thirty inches in width. In addition, a double cutter assembly spaced on opposite sides of a liner material delivery system may follow the path of a single trench and widen opposite sides of the trench by the two cutter assemblies with a membrane liner delivered into the center of the widened trench.

Accordingly, it is an object of the present invention to provide a vertical liner in a trench with the liner material being unrolled from a spindle in a liner delivery system with adjacent sections of liner material being secured to each other by a vertical seam.

It is another object of the present invention to provide a vertical liner in a trench with the liner material being unrolled from a vertically-oriented spindle in a liner delivery system with adjacent sections of liner material being secured to each other by a vertical seam where permeable liner material is used or alternately impermeable liner material is used.

It is still another object of the present invention to provide a vertical liner in a trench with the liner material being unrolled from a spindle in a liner delivery system with adjacent sections of liner material being secured to each other by a vertical seam where permeable liner material is used or alternately impermeable liner material is used with at least one side of the liner being backfilled with a fill material.

It is still yet another object of the present invention to provide a vertical liner in a trench with the liner material being unrolled from a spindle in a liner delivery system with adjacent sections of liner material being secured to each other by a vertical seam where permeable liner material is used or alternately impermeable liner material is used with at least one side of the liner material being backfilled with a fill material and a horizontally-oriented water recovery system being installed adjacent to and simultaneously with the installation of the liner material.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
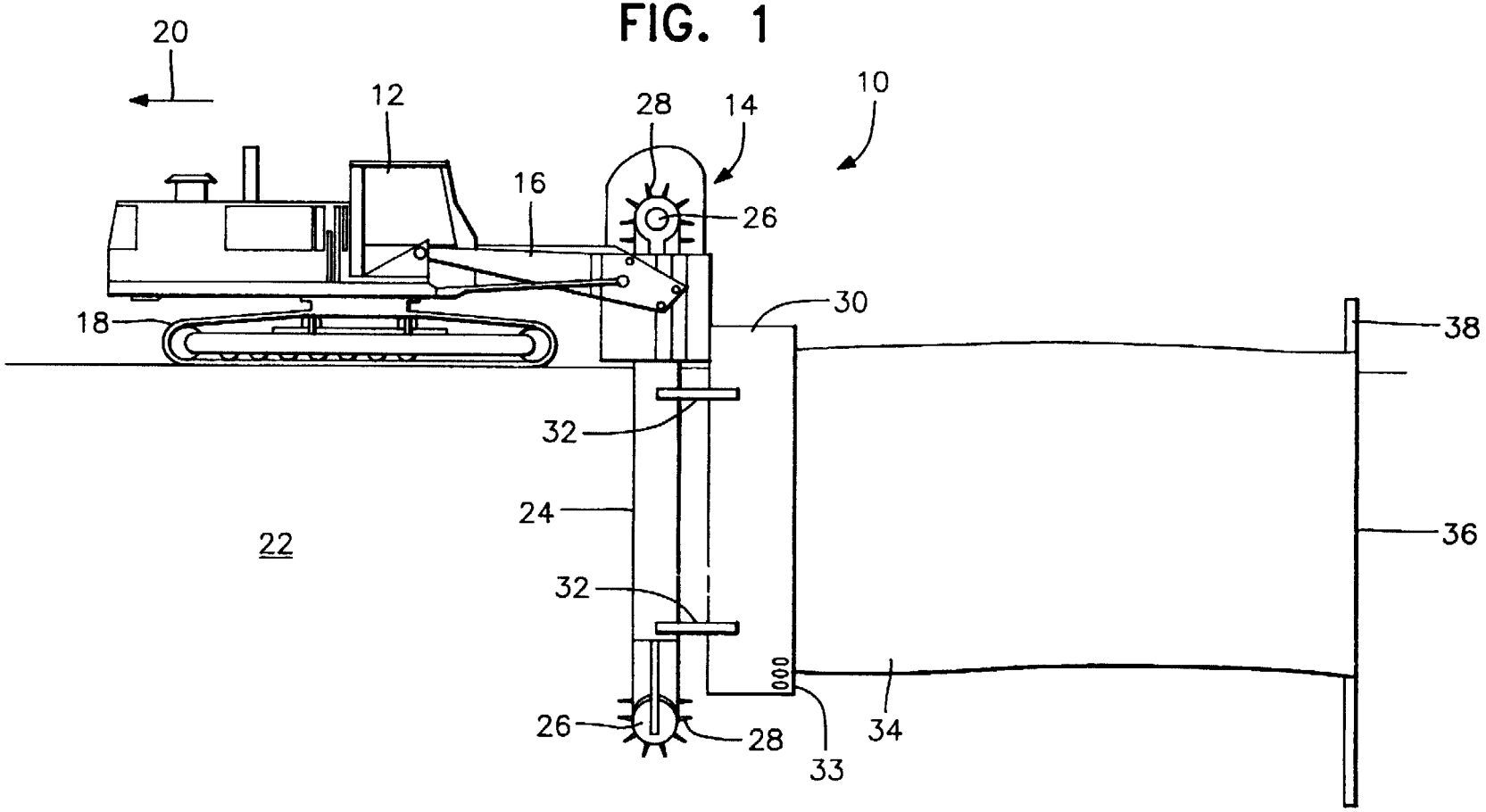
FIG. 1 is a sectional schematic view of a trenching machine and liner material delivery system for delivery of liner material in a vertical orientation.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1–6, in particular, a barrier wall installation system embodying the teachings of the subject invention is generally designated as 10. With reference to its orientation in FIG. 1, the barrier wall installation system includes a trenching machine 12 having a cutter assembly 14 mounted at one end of a boom 16 pivotally mounted on the trenching machine 12. Tracks 18 cause the trenching machine to move in the direction of arrow 20 across the soil The cutter assembly 14 includes a belt 24 driven over two wheels 26. The belt 24 includes a plurality of cutting arms 28, with only a few shown in the drawing, it being understood that the entire belt 24 is covered with cutting arms 28. As the trenching machine 12 advances in the direction of arrow 20, the cutting assembly 14 excavates the soil to a depth of 14–50 feet depending upon the height of the cutting assembly 14. A trench of a preferred width of 14" is formed.

Connected rearwardly of the cutting assembly 14 is a liner delivery system 30 connected by straps 32 to the cutting assembly 14. The liner delivery system 30 receives vertically-oriented rolls of liner material and dispenses the vertically-oriented liner material 34 in the trench formed by the trenching machine 12. To initiate paying out of the liner material 34 from the liner delivery system 30, a leading edge 36 of the liner material is connected to a stake 38 or other mechanical assists so as to anchor the edge 36 of the liner material 34 within the formed trench.

In FIGS. 2–6, alternative embodiments of a liner material delivery system are shown. These systems may be used with a permeable or an impermeable liner material of a thickness of 40–150 mills, for example.

Figure 2:
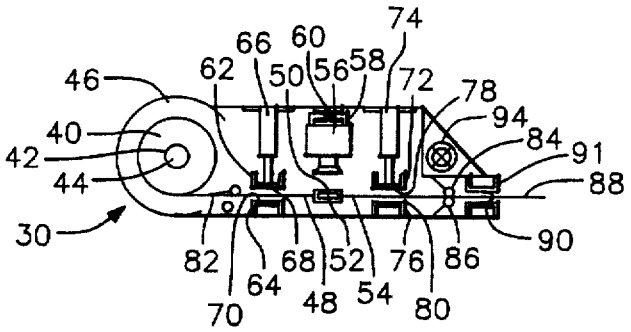
FIG. 2 is a cross-sectional view of the liner material delivery system used for connecting adjacent sections of liner material with a tongue and groove mechanical joint.

For the delivery system of FIG. 2, a roll of HDPE liner material is rolled off of a supply roll (or received from the manufacturer supplied on a pre-assembled spindle) and rerolled for delivery onto a hollow spindle 44. The supply roll is unwound to wind liner material to a predetermined diameter for delivery onto the spindle. One part of a waterproof joint assembly, such as a tongue and groove hydrophilic connection joint, is welded at a leading edge of the liner material delivered in a vertical orientation onto the spindle.

At the trailing edge of the liner material, the other portion of the tongue and groove locking joint assembly is welded. This operation is performed for a plurality of rolls to be used with the trenching machine of the present invention.

As shown in FIG. 2, a crane lowers a roll 40 of high-density polyethylene liner material on a vertical rod 42 onto a spindle 44 of roll placement area 46. A leading edge 48 of the roll 40 includes one part 50 of a tongue and groove connection joint. As the roll 40 is lowered into the roll placement area 46, the part 50 of the tongue and groove connection joint is connected with the other part 52 of a tongue and groove connection joint located at a trailing edge 54 of a previously-installed roll of liner material.

An inspection camera 56, such as a CCD camera, having a retaining bracket 58 slidably mounted on an I-beam 60 is movable vertically on the I-beam 60 along the entire height of the I-beam which corresponds to a height of the tongue and groove joint assembly. The camera inspects the connection of the joint along the entire length of its vertical height. The camera is electrically connected to a monitor located at a remote location, for visual inspection of a seam by a quality control operator.

In the instances where a horizontally-extending seam is formed in the liner material as would be required for deep trenches, the camera is lowered to a height of the horizontal seam. The seam is monitored by the camera as the liner material is unrolled and the horizontally-extending seam passes the camera.

During inspection of a new roll of liner material secured to a previously-installed roll, brake pad 62 is advanced towards stationary pad 64 by piston cylinder unit 66 so as to engage the leading edge 48 of a new roll of liner material. A leading surface 68 of brake pad 62 is rubber-coated to cushion the contact of the brake pad against the stationary pad 64 which includes a rubber coating 70 on its leading surface. This prevents any imperfections from being introduced into the liner material during holding of the edges of the liner material.

Similarly, brake pad 72 is advanced by piston cylinder unit 74 against stationary pad 76 with rubber-coated leading surface 78 of brake pad 72 engaging the rubber-coated leading surface 80 of stationary pad 76. Brake pad 72 holds trailing edge 54 of the already-installed liner material section to facilitate a secure interconnection and inspection of parts 50 and 52 of the waterproof joint assembly.

As the trenching machine 12 is advanced, tension gauge rod 82 is located on a surface of the liner material being installed so as to measure the tension of the liner material and control the turntable of spindle 44 for controlled movement of the liner material. The liner material then passes between guide rollers 84 and 86 prior to passing through flexible seal 88 formed by flexible flaps 90 and 91. The seal 88 prevents the migration of liquids into the cavity 92 formed by the liner material delivery system 30 and also prevents migration of liquid out of the cavity 92 in the instance where the water level in the cavity is maintained above that of the surrounding environment. Injection/extraction pump 94 provides a desired level of fluid within the cavity 92 according to the conditions of the surrounding environment.

Figure 3:
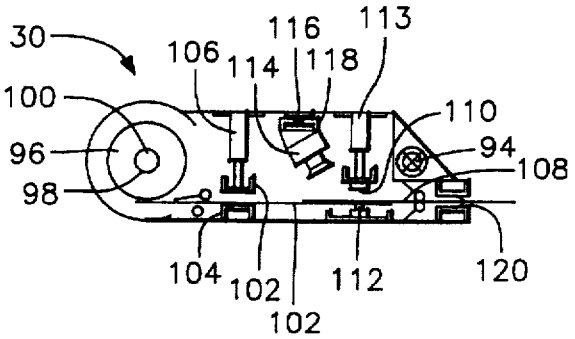
FIG. 3 is a sectional view of the liner material delivery system having a welding mechanism for bonding adjacent sections of liner material.

In FIG. 3, an alternative method of sealing adjacent edges of an already-installed and succeeding sections of liner material is disclosed. As in FIG. 2, in FIG. 3, a roll 96 of liner material on a rod 98 is lowered by a crane onto a spindle 100. A leading edge 102 of the liner material is advanced into the liner delivery system 30. Brake pad 103 is advanced towards stationary pad 104 to hold the leading edge 102 in position by the actuation of hydraulic piston cylinder 106. A trailing edge 108 of an already-installed section of liner material is placed over the leading edge 102 of the to-be-installed section of liner material between heat bonding heads 110 and 112.

The head 110 is advanced by piston cylinder unit 113 to press the trailing edge 108 onto leading edge 102 and form a bond in a vertical seam between the two sections of liner material. An inspection camera 114 is vertically movable along I-beam 116 as retained by bracket 118 so as to inspect the weld along the entire height of the liner material. Upon inspection of a satisfactory weld, the brake 102 and welding heads are withdrawn and the trenching machine 12 is advanced to continue installing vertically-extending sections of liner material through seal 120.

Figure 4:
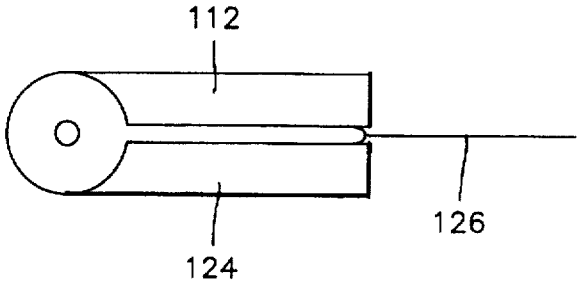
FIG. 4 is a plan view of backfill channels located above a liner material delivery system for feeding backfill material on both sides of the liner material as the liner material is being installed.
Figure 5:
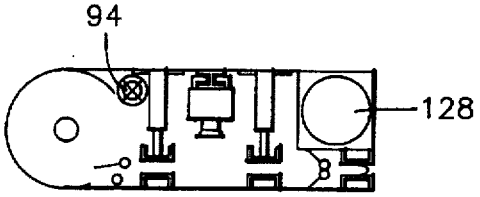
FIG. 5 is a cross-sectional view of a liner material delivery system similar to the system shown in FIG. 2, but having in addition a horizontal pipe installation feed tube.

In the embodiments of FIGS. 2, 3, and 5, as shown in FIG. 4, two grout backfill channels 122, 124 may be optimally located above the liner material delivery system 30 for feeding backfill material onto opposite sides of the installed liner material 126 while the soil is excavated by the cutting assembly 14 or alternatively filling opposite sides of the liner material 126 in the trench with grout or other fill independently fed to the channels 122, 124 for placement on opposite sides of the liner material 126.

In FIG. 5, a liner material delivery system similar to the system shown in FIG. 2, is shown which includes a different location for the injection extraction pump 94 and also includes a pipe channel 128 for feeding sections of corrugated perforated pipe which will pass through the pipe channel 128 and be laid adjacent to a bottom edge of the liner material at the bottom of the trench formed by the trenching machine 12. The corrugated perforated pipe is used in a manner as disclosed in U.S. Pat. No. 4,927,292 herein incorporated by reference.

Figure 6:
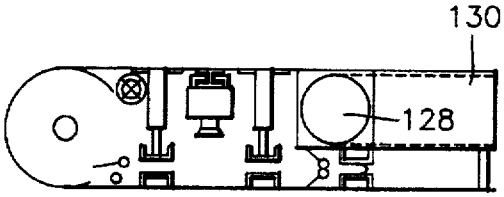
FIG. 6 is a cross-sectional view of a liner material delivery system having a granular backfill hopper for filling in a trench on one side of an installed liner material.

The liner material delivery system shown in FIG. 6 is similar to the one shown in FIG. 5 except for the inclusion of a backfill channel 130 located on one side of the to-be-installed liner material. The backfill channel 130 may feed soil removed by the cutting assembly 14 onto one side of the installed liner material or alternatively may deliver other fill material delivered to the backfill channel 130 from another source.

Figure 7:
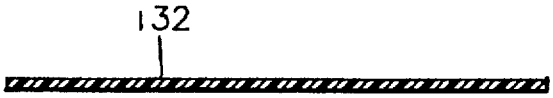
FIG. 7 is a plan view of an impermeable HDPE membrane liner material installation.
Figure 8:
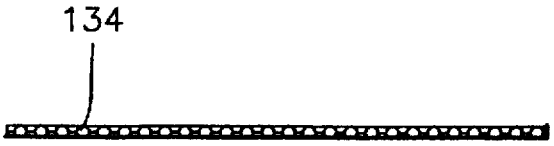
FIG. 8 is a cross-sectional view of a permeable liner material installation.
Figure 10:
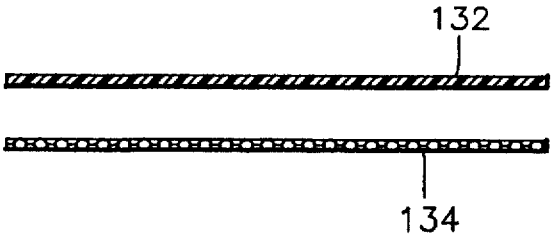
FIG. 10 is a plan view of both a permeable liner material and an impermeable liner material installed parallel to one another.
Figure 12:
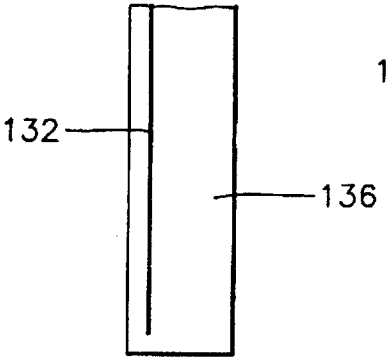
FIG. 12 is a cross-sectional view of an impermeable liner material installation.
Figure 13:
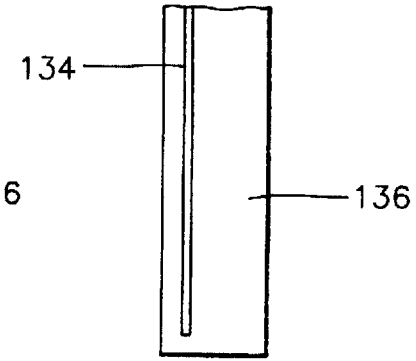
FIG. 13 is a cross-sectional view of a permeable liner material installation.
Figure 14:
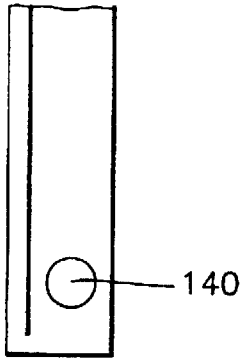
FIG. 14 is a cross-sectional view of an impermeable liner material with an adjacent horizontal well line.

FIG. 7 illustrates an impermeable liner material 132 whereas FIG. 8 illustrates a permeable liner material 134 which allows for a treatment of fluid passing therethrough. Installation of either an impermeable liner material 132 or a permeable liner material 134 is achieved by use of the liner material delivery system shown in FIGS. 2 or 3. Additionally, a treatment wall of an impermeable liner material serving as a barrier wall, as shown in FIG. 10, is installed using a liner material delivery system as shown in FIG. 2 or 3 making two passes with the trenching machine to install the two liners. Similarly, FIGS. 12 and 13 illustrate the installation of either a barrier wall of an impermeable liner material 132 in FIG. 12 within a trench 136 or alternatively installation of a permeable liner material 134 serving as a treatment wall within a trench 136 as shown in FIG. 13.

Figure 9:
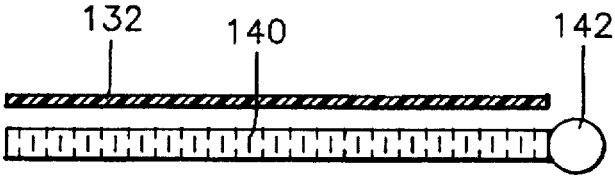
FIG. 9 is a plan view of impermeable liner material installed with a horizontal well line.
Figure 11:
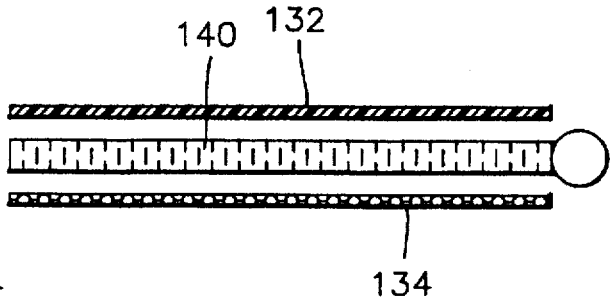
FIG. 11 is a plan view of a horizontal well line installed between a permeable liner material and an impermeable liner material.
Figure 15:
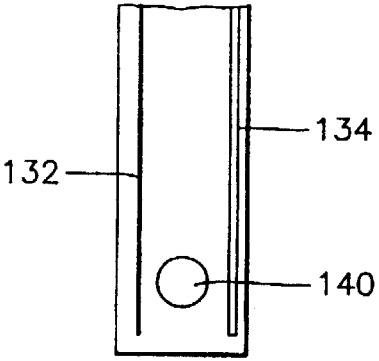
FIG. 15 is a cross-sectional view of a horizontal well line installed between an impermeable liner material and a permeable liner material.
Figure 17:
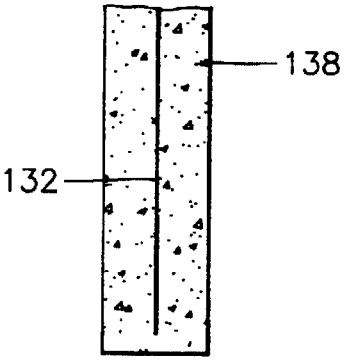
FIG. 17 is a cross-sectional view of an impermeable liner material secured in a trench by a grout or slurry mixture.

To install a bentonite slurry wall, a biopolymer wall, or a concrete grout wall 138 with a liner material 132 positioned in a center of the trench as is illustrated in FIG. 17, the liner material delivery system shown in FIG. 4 is used. To obtain the configuration of an impermeable liner material 132 adjacent to a horizontal well line 140 having a vertical riser 143, as shown in FIGS. 9 and 11, the liner material delivery system of FIG. 5 is used. Similarly, as shown in FIGS. 11 and 15, the liner material delivery system of FIG. 5 is initially used followed by use of the liner material delivery system of FIGS. 2 and 3 to install a second layer of liner material.

Figure 16:
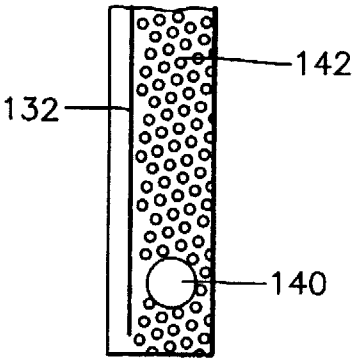
FIG. 16 illustrates an impermeable liner material and a horizontal well line with a granular backfill material supporting a horizontal well line and the impermeable liner material in a trench.
Figure 19:
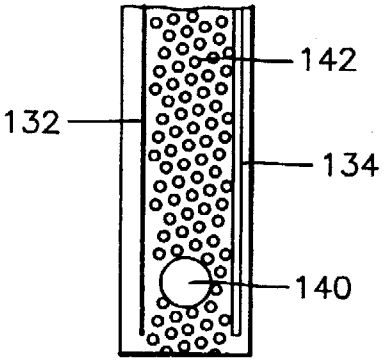
FIG. 19 is a cross-sectional view of a horizontal well line located between a permeable liner material and an impermeable liner material with granular fill material located in the trench.

When a highly-permeable backfill 142 is required over and around a horizontal well line 140, the liner material delivery system shown in FIG. 6 is used as illustrated in FIGS. 16 and 19 with the configuration shown in FIG. 19 requiring another pass of the liner material delivery system of FIG. 2 or 3 to install a second layer of liner material.

Figure 18:
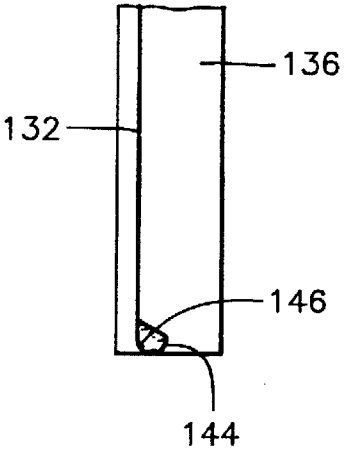
FIG. 18 is a cross-sectional view of an impermeable liner material deformed to have a "J" formation at a lowermost edge with this deformation used to hold grout to key into an underlying layer of lower permeability.

In FIG. 18, a lowermost edge portion 144 of the liner material 132 is fed from the delivery system through a profile section to form a "J" formation on the bottom of the liner material 132. The "J" formation holds grout 146 to effect keying of the bottom of the liner material 132 into an underlying layer of lower permeability. The portion 144 would contact, for example, an impermeable clay material to complete an impermeable zone. The grout 146 can be bentonite cement or similar type of sealings material which is injected within the trench 136 by means of a series of injection openings or nozzles 33 as shown in FIG. 1. A tube can be used to deliver the grout from the surface to any depth required.

Figure 20:
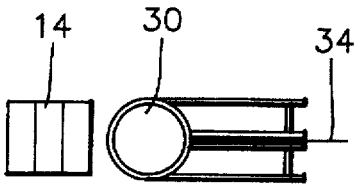
FIG. 20 is a schematic plan view of a liner material delivery system and a cutter assembly.
Figure 21:
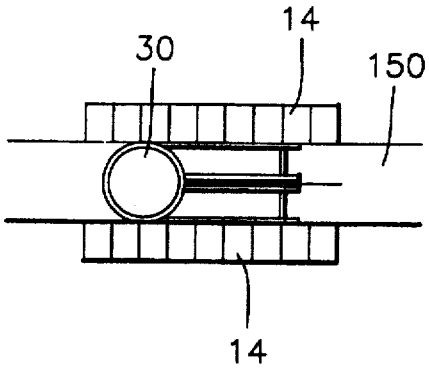
FIG. 21 is a schematic plan view of a liner material delivery system and a double cutter assembly.

In FIG. 20, the liner material delivery system 30 for delivering liner material 34 is schematically shown. The liner material delivery system is connected to a single cutter apparatus 14 as shown in FIG. 1. However, when it is necessary to provide an increased width trench, an initial trench 150 is widened by using two cutter assemblies 14 on opposite sides of the liner material delivery system 30 as shown in FIG. 21.

Figure 22:
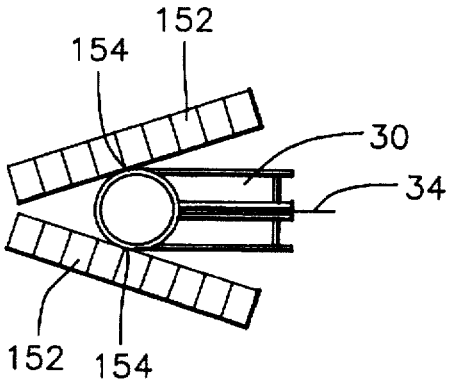
FIGS. 22 and 23 are schematic plan views of a liner material delivery system and a pivoted double cutter assembly.
Figure 23:
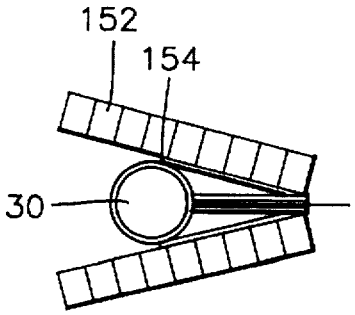

Alternatively, as shown in FIGS. 22 and 23, two cutter assemblies 152 are pivotally mounted on liner material delivery system 30 about pivot point 154 for movement in front of and behind the liner material delivery system 30. In this embodiment, the delivery system 30 is mounted on a tractor as is shown in FIG. 1. The pivoted cutter assemblies clear a widened path over an already-existing trench or provide a wide trench for installation of liner material 34. In the event that the cutter assemblies 152 are pivoted behind the liner material delivery system, the liner material system will have converging sidewalls as shown in FIG. 23 but without changing the contents of the delivery system as shown in FIGS. 2 through 6, merely modifying their position whithin the system 30.

The various embodiments of installed liner material as shown in FIGS. 12–19 may be used for surrounding a plume 180 of contamination at a contaminated material site. The liner material 182 is positioned to surround the plume 180, with opposite ends 184, 186 of the liner material secured together by a connector means 188 as shown in FIGS. 25–31.

Figure 24:
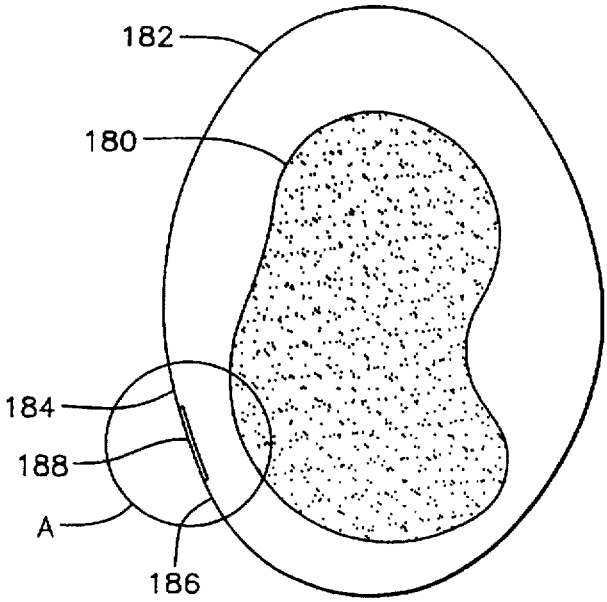
FIG. 24 is a schematic plan view of liner material encircling a plume of contamination.
Figure 25:
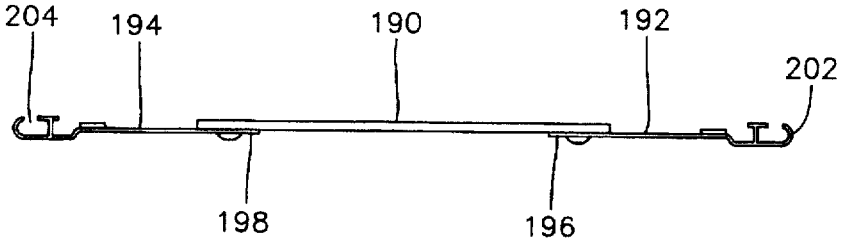
FIG. 25 is an enlarged plan view of a rigid material connector of opposite ends of liner material.
Figure 26:
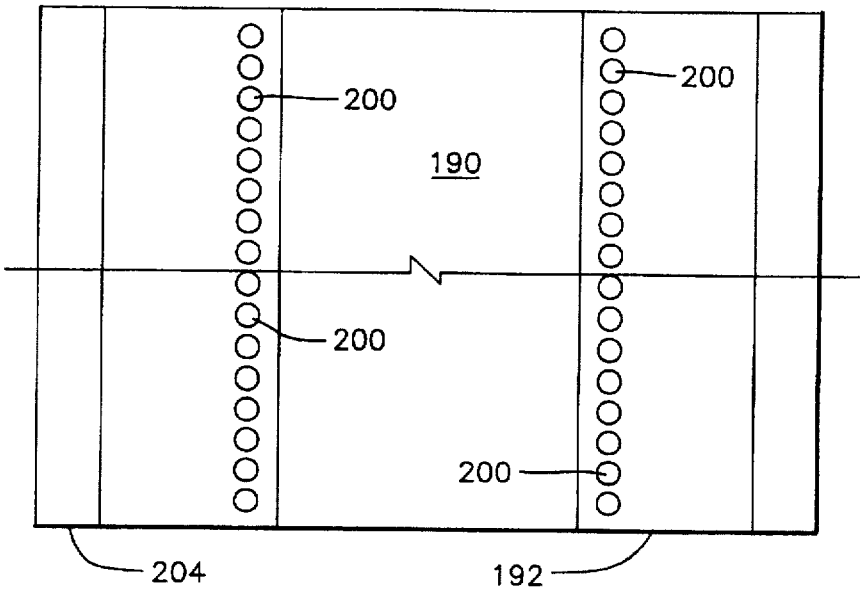
FIG. 26 is an elevational view of the rigid material connector.
Figure 28:
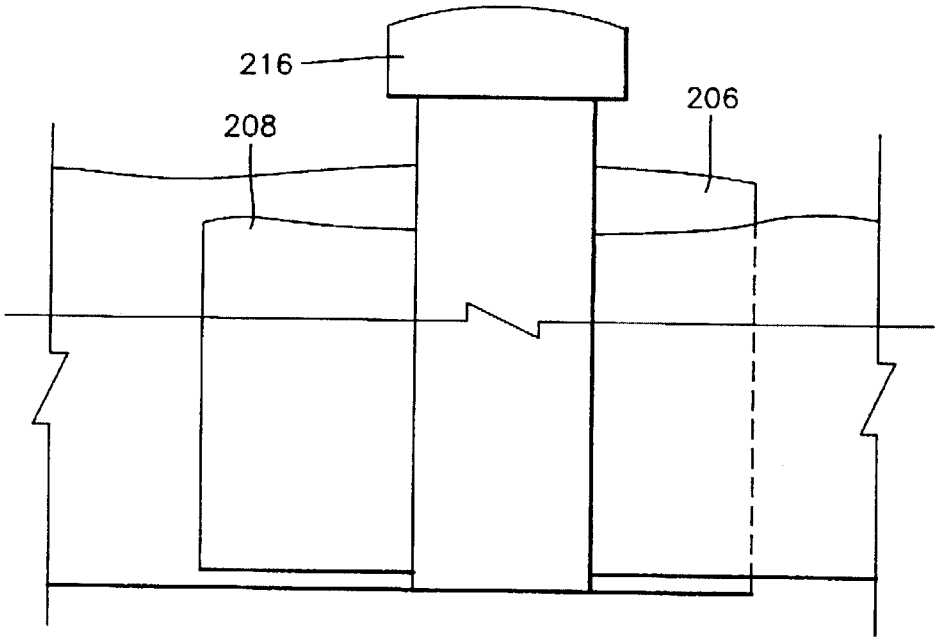
FIG. 28 is a schematic elevational view of the closure tube with opposite ends of liner material overlapping each other and passing through the closure tube.
Figure 27:
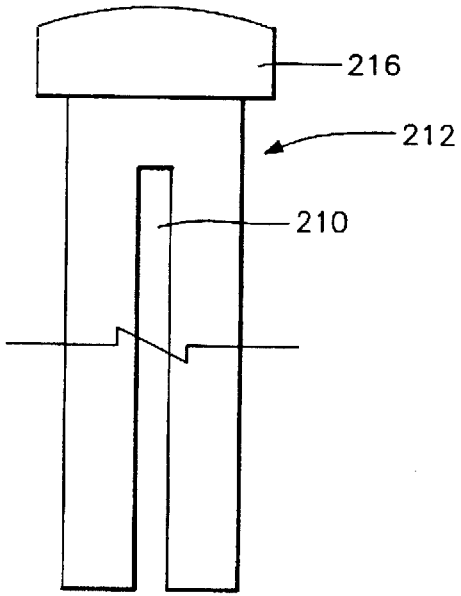
FIG. 27 is an elevational view of a closure tube.
Figure 29:
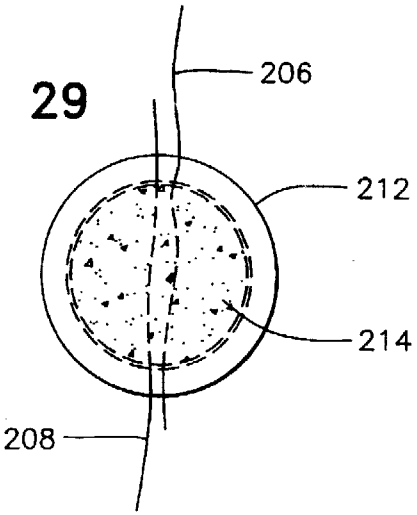
FIG. 29 is a sectional view of the closure tube with grout or bentonite filling the closure tube to secure opposite ends of the liner material in the closure tube.

In one embodiment of the encircled area "A" of FIG. 24, shown in FIGS. 25 and 26, a panel 190 made of metal or stiffened material includes sections 192, 194 of flexible liner material. One end 196, 198 is secured to the panel 190 by bolts 200 to form a water- or vapor-tight seal with the panel 190 so as to prevent migration of liquids or vapors around the panel 190. The ends 202, 204 of the liner material sections 192, 194 include a securing means, for example a tongue and groove profile, so that the panel 190 serves to connect opposite ends 184, 186 of a liner material surrounding a plume 180 of contamination.

In an alternative embodiment, opposite ends 206, 208 of liner material are threaded through a slot 210 of a closure tube 212. An interior hollow section 214 of the closure tube 212 is filled with grout or bentonite to secure the ends 206, 208 of liner material within the closure tube 212. A cap 216 is then secured to the top of the closure tube to seal the closure tube in place.

Figure 30:
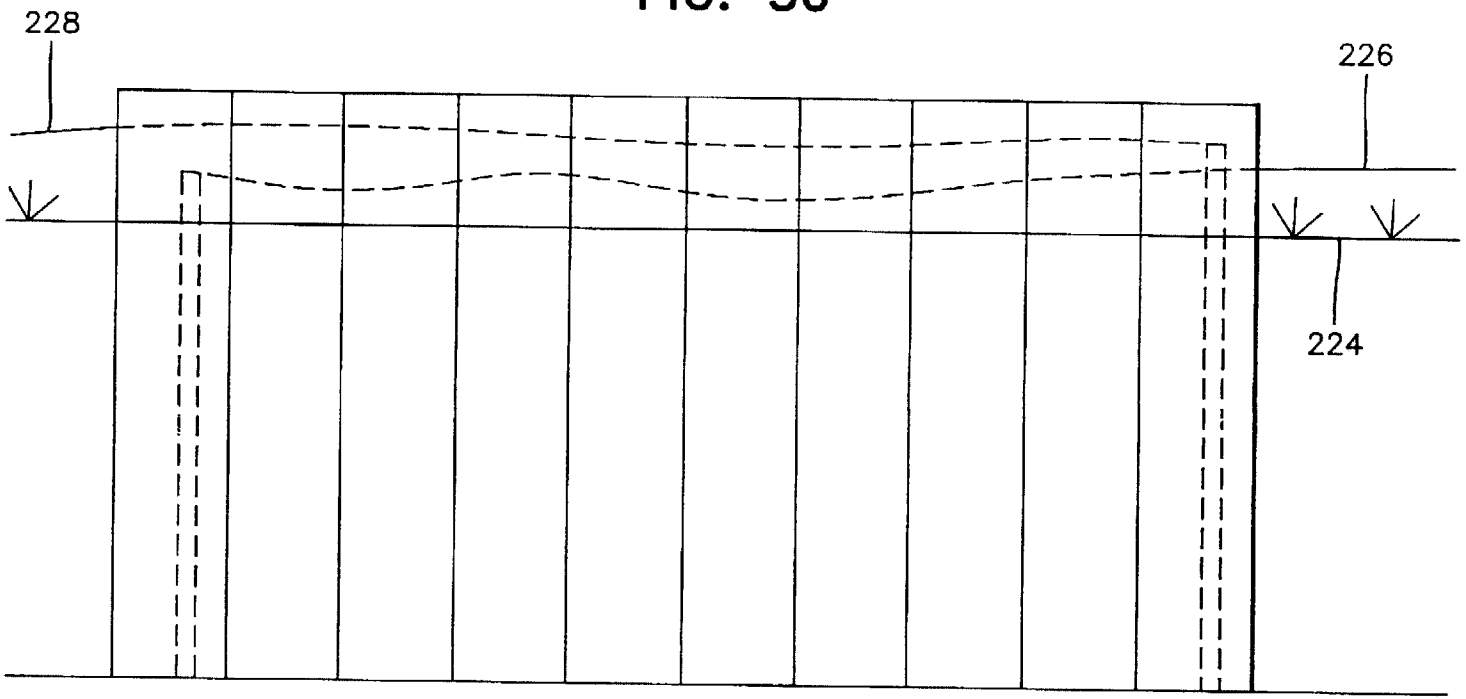
FIG. 30 is an elevational view of opposite ends of liner material terminating and overlapping between two steel sheets.
Figure 31:
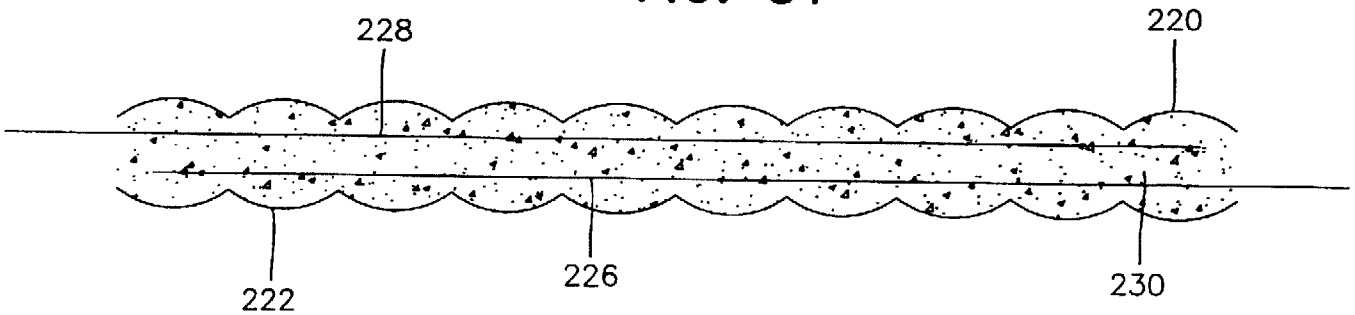
FIG. 31 is a sectional view of overlapped opposite ends of liner material located between two steel sheets and filled with bentonite to secure the opposite ends of liner material in place.

In a third embodiment as shown in FIGS. 30 and 31, two steel sheets 220, 222 are secured below ground level 224 within a trench. Opposite ends 226, 228 of liner material terminate between the two sheets 220, 222. The space between the two sheets 220, 222 is then filled with bentonite fill 230 to secure the overlapped ends 226, 228 between the two sheets so as to define a connector means for securing opposite ends of a liner material passing around a plume 180 of contamination.

Having described the invention, many modifications thereto will become apparent to those skilled in the art to which it pertains without deviation from the spirit of the invention as defined by the scope of the appended claims.

I claim:

1. A barrier wall installation system comprising:

a tractor, a cutter assembly mounted on said tractor for digging a trench of a depth up to sixty feet, a roll of liner material, a delivery device mounted on said cutter assembly for locating a single layer of said roll of liner material in a vertically-oriented position in said trench simultaneously dug by said cutter assembly, said delivery device being vertically elongated and enclosed for receiving said roll of liner material positioned in a vertical orientation in said delivery device with the liner material being initially positioned in and emanating in said single layer from an elongated opening of said delivery device in a same orientation as the liner material will be positioned in the trench simultaneously dug by said cutter assembly, at least one of said delivery device and said roll of liner material including a connector for securing a trailing edge of one length of liner material to a leading edge of another length of liner material with a leak-proof joint, said cutter assembly digging said trench and feeding fill material into said trench simultaneously with unrolling said liner material from said delivery device, said fill material being the same material on both sides of said single layer of liner material.

2. A barrier wall installation system according to claim 1, wherein said delivery means includes a spindle for receipt of said roll of liner material.

3. A barrier wall installation system according to claim 1, wherein said elongated opening of said delivery means includes seal members for sealing an interior of said delivery means against communication of fluids from outside said delivery means into said delivery means.

4. A barrier wall installation system according to claim 1, wherein said delivery means includes a camera for inspecting a seam of the liner material.

5. A barrier wall installation system according to claim 4, wherein said camera is vertically movable.

6. A barrier wall installation system according to claim 1, wherein said delivery means includes a pump for one of extraction from and injection into of fluids with respect to said delivery means.

7. A barrier wall installation system according to claim 1, wherein said delivery means includes a pipe channel for feeding perforated pipe therethrough and into the trench dug by the cutter assembly.

8. A barrier wall installation system according to claim 1, wherein said delivery means includes means for holding the liner material adjacent to the initial position of the liner material in said delivery means.

9. A barrier wall installation system comprising:

a tractor for moving across the earth, a cutting assembly mounted on said tractor for digging a trench behind said tractor of a depth up to sixty feet, and a roll of liner material, a delivery device mounted on said cutting assembly for locating a single layer of said roll of liner material in a vertically-oriented position and a collection pipe in a horizontally-extending position in a trench simultaneously dug by said cutter assembly, said delivery device being vertically elongated and enclosed for receiving said roll of liner material positioned in a vertical orientation in said delivery device with the liner material being initially positioned in and emanating in said single layer from an elongated opening of said delivery device in a same orientation as the liner material will be positioned in the trench simultaneously dug by said cutting assembly, at least one of said delivery device and said roll of liner material including a connector for securing a trailing edge of one length of liner material to a leading edge of another length of liner material with a leak-proof joint, said cutting assembly digging said trench and feeding fill material into said trench simultaneously with unrolling said liner material from said delivery device, said fill material being the same material on both sides of said single layer of liner material.

10. A barrier wall installation system according to claim 9, wherein said delivery means includes channel means for receipt of fill material to be positioned adjacent to said liner material and on top of said collection pipe.

11. A barrier wall installation system according to claim 9, wherein said collection pipe is perforated.

12. A barrier wall system comprising:

a tractor, a cutter assembly mounted on said tractor for digging a trench of a depth up to sixty feet on one side of an area of contaminated soil, a delivery device mounted on said cutter assembly for locating an impermeable liner material placed in said trench in a vertical orientation on said one side of said area of contaminated soil during one pass of said cutter assembly to prevent passage of groundwater, a permeable liner material placed in said trench in a vertical orientation between said area of contaminated soil and said impermeable liner material during another pass of said cutter assembly for allowing flow through of contaminated groundwater, said permeable liner material including treatment materials for treating in situ contaminated water passing therethrough, and a collection pipe buried in the earth between said impermeable liner material and said impermeable liner material for collection of groundwater having passed in a direction from said contaminated soil through said permeable liner material and into said collection pipe, said delivery device being vertically elongated and enclosed for receiving one of said impermeable liner material and said permeable liner material positioned in a vertical orientation in said delivery device with one of the liner materials being initially positioned in and emanating in said single layer from an elongated opening of said delivery device in a same orientation as the one liner material will be positioned in the trench simultaneously dug by said cutter assembly, at least one of said delivery device and said one liner material including a connector for securing a trailing edge of one length of said one liner material to a leading edge of another length of said one liner material with a leak-proof joint, said cutter assembly digging said trench and feeding fill material into said trench simultaneously with unrolling said liner material from said delivery device.

13. A barrier wall installation system according to claim 12, wherein said collection pipe is perforated.

14. A barrier wall installation system according to claim 12, wherein said collection pipe is horizontally extending.

15. A barrier wall installation system according to claim 14, wherein said collection pipe is perforated.

16. A barrier wall installation system according to claim 12, wherein said collection pipe is covered with permeable backfill material.

17. A barrier wall system comprising:

a tractor, a cutter assembly mounted on said tractor for digging a trench of a depth up to sixty feet around a plume of contamination, a roll of liner material for containing migration of said plume of contamination, said liner material having two ends and being at least partially buried in said trench around said plume of contamination, said two ends being overlapped, a delivery device mounted on said cutter assembly for locating a single layer of said liner material in a vertically oriented position in said trench simultaneously dug by said cutter assembly, said delivery device being vertically elongated and enclosed for receiving said roll of liner material positioned in a vertical orientation in said delivery device with the liner material being initially positioned in and emanating in said single layer from an elongated opening of said deliver means in a same orientation as the liner material will be positioned in the trench simultaneously dug by said cutter assembly, and a connector device including two rigid sheets for securing said two overlapped ends of said liner material therebetween, said cutter assembly digging said trench and feeding fill material into said trench simultaneously with unrolling said liner material from said delivery device, said fill material being the same material on both sides of said single layer of liner material.

18. A barrier wall installation system according to claim 17, wherein said liner material is made of impermeable liner material.

19. A barrier wall installation system comprising:

a tractor, a cutter assembly on said tractor digging a trench of a depth up to sixty feet around a plume of contamination, a roll of liner material for containing migration of said plume of contamination, said liner material having two ends and being at least partially buried in said trench around said plume of contamination, said two ends being overlapped, a delivery device mounted on said cutter assembly for locating a single layer of said liner material in a vertically oriented position in said trench simultaneously dug by said cutter assembly, said delivery device being vertically elongated and enclosed for receiving said roll of liner material positioned in a vertical orientation in said delivery device with the liner material being initially positioned in and emanating in said single layer from an elongated opening of said delivery device in a same orientation as the liner material will be positioned in the trench simultaneously dug by said cutter assembly, and a connector device including a closure tube for securing said two overlapped ends of said liner material therein, said cutter assembly digging said trench and feeding fill material into said trench simultaneously with unrolling said liner material from said delivery device, said fill material being the same material on both sides of said single layer of liner material.

20. A barrier wall installation system comprising:

a tractor, a cutter assembly mounted on said tractor for digging a trench of a depth up to sixty feet around a plume of contamination, a roll of liner material for containing migration of said plume of contamination, said liner material having two ends and being at least partially buried in said trench around said plume of contamination, a delivery device mounted on said cutter assembly for locating a single layer of said liner material in a vertically oriented position in said trench simultaneously dug by said cutter assembly, said delivery device being vertically elongated and enclosed for receiving said roll of liner material positioned in a vertical orientation in said delivery device with the liner material being initially positioned in and emanating in said single layer from an elongated opening of said delivery device in a same orientation as the liner material will be positioned in the trench simultaneously dug by said cutter assembly, and a connector device including a rigid panel for connecting said two ends of said liner material so as to encircle said plume of contamination, said cutter assembly digging said trench and feeding fill material into said trench simultaneously with unrolling said liner material from said delivery means, said fill material being the same material on both sides of said single layer of liner material.

21. A barrier wall installation system comprising:

a tractor, a cutter assembly mounted on said tractor for digging a trench of a depth up to sixty feet around a plume of contaminated liquid, a roll of liner material for treating said plume of contaminated liquid, said liner material being at least partially buried in said trench at least partially around said plume of contaminated liquid, and said liner material being made of permeable liner material including treatment materials for treating in situ said plume of contaminated liquid as said plume of contaminated liquid passes therethrough, a delivery device mounted on said cutter assembly for locating a single layer of said liner material in a vertically oriented position in said trench simultaneously dug by said cutter assembly, at least one of said delivery device and said roll of liner material including a connector for securing a trailing edge of one length of liner material to a leading edge of another length of liner material with a leak-proof joint, said cutter assembly digging said trench and feeding fill material into said trench simultaneously with unrolling said liner material from said delivery device, said fill material being the same material on both sides of said single layer of liner material.

* * * * *